US006782851B2

(12) United States Patent
Geyer

(10) Patent No.: US 6,782,851 B2
(45) Date of Patent: Aug. 31, 2004

(54) TWO-STROKE ENGINE IN A PORTABLE, MANUALLY-GUIDED IMPLEMENT

(75) Inventor: Klaus Geyer, Sulzbach (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/154,891

(22) Filed: May 23, 2002

(65) Prior Publication Data

US 2002/0185087 A1 Dec. 12, 2002

(30) Foreign Application Priority Data

Jun. 11, 2001 (DE) ..... 101 28 197

(51) Int. Cl.[7] ..... F02B 33/04
(52) U.S. Cl. ..... 123/73 B
(58) Field of Search ..... 123/73 B, 73 C, 123/73 AA, 65 P, 73 PP, 73 A

(56) References Cited

U.S. PATENT DOCUMENTS

| | | | | |
|---|---|---|---|---|
| 2,888,798 A | | 6/1959 | Kilchenmann | |
| 4,383,503 A | | 5/1983 | Griffiths | |
| 4,987,864 A | * | 1/1991 | Cantrell et al. | 123/65 BA |
| 6,273,037 B1 | * | 8/2001 | Cobb, Jr. | 123/73 B |
| 6,289,856 B1 | * | 9/2001 | Noguchi | 123/73 PP |

FOREIGN PATENT DOCUMENTS

| | | |
|---|---|---|
| DE | 38 17 529 | 12/1988 |
| JP | 03100318 | 4/1991 |
| WO | WO 00/11334 | 3/2000 |

* cited by examiner

*Primary Examiner*—Tony M. Argenbright
*Assistant Examiner*—Hyder Ali
(74) *Attorney, Agent, or Firm*—R W Becker & Associates; R W Becker

(57) ABSTRACT

A two-stroke engine is provided for a manually-guided implement. Formed in a cylinder is a combustion chamber that is delimited by a reciprocating piston that drives a crankshaft via a connecting rod. An outlet is provided for withdrawing exhaust gases out of the combustion chamber, and an inlet is provided for supplying fresh mixture to the combustion chamber. The inlet forms one end of a storage channel, the other end of which opens out via a window controlled by the piston into the crankcase. Via a fuel-supplying mixture channel, the storage channel is connected with a fuel supply. Combustion air is supplied to the crankcase via a crankcase inlet, with the combustion air being conveyed into the combustion chamber via a transfer channel and a transfer window. The storage channel is connected to the mixture channel via a connecting channel that is controlled by the piston.

10 Claims, 1 Drawing Sheet

TWO-STROKE ENGINE IN A PORTABLE, MANUALLY-GUIDED IMPLEMENT

BACKGROUND OF THE INVENTION

The present invention relates to a two-stroke engine, especially as a drive motor in a portable, manually-guided implement such as a power chain saw, a brush cutter, a trimmer, a cut-off machine, or the like.

A two-stroke engine of this type is known from WO 00/11334. Formed in a cylinder is a combustion chamber that is delimited relative to a crankcase by a reciprocating piston. By means of a connecting rod, the piston drives a crankshaft that is rotatably mounted in the crankcase and that drives the tool.

The exhaust gases that result during the combustion in the combustion chamber are withdrawn via an exhaust gas outlet, which is disposed across from an inlet that supplies fresh mixture to the combustion chamber. The inlet forms one end of a storage channel, the other end of which opens out into the crankcase via a window that is controlled by the piston. In this connection, the storage channel is connected with a mixture-forming device that supplies fuel, whereby combustion air is essentially supplied to the crankcase via a crankcase inlet, with the combustion air being transferred to the combustion chamber via a transfer channel.

Such a two-stroke engine utilizes, in a special way, the high pressure level of the exhaust gases for the introduction of a rich fuel mixture into the combustion chamber. Critical in this connection is that the storage channel have such a length that an adequate volume is available for drawing in the necessary rich mixture, and furthermore that an effective introduction of this mixture into the combustion chamber is ensured. For this purpose, the inlet is opened approximately simultaneously with the outlet, so that the exhaust gas that is under high pressure enters the storage channel via the inlet and moves through the storage channel as a pressure wave. Before the pressure wave can reach the other end of the storage channel, the latter is closed by the upwardly moving piston, so that the pressure wave is reflected at the piston skirt and returns. Via the now completely open inlet, the returning pressure wave conveys the mixture stored in the storage channel in a pulse-like manner into the combustion chamber, to which the combustion air that is necessary for the combustion is supplied via the combustion channel.

To store a fuel in the storage channel, a fuel supply is connected in the region of the inlet. This fuel supply requires a check valve so that during the introduction of the rich mixture by the reflected exhaust gas pulse, a return flow of fuel via the mixture channel is prevented. Such a check valve influences the entire system due to its characteristics, so that a satisfactory supply of fuel for fuel storage in the storage channel cannot always be achieved in all operating ranges of the internal combustion engine.

It is therefore an object of the present invention to improve an internal combustion engine of the aforementioned general type in such a way that a sufficient supply of fuel into the storage channel, in a manner free of disruption, is ensured under all operating conditions.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
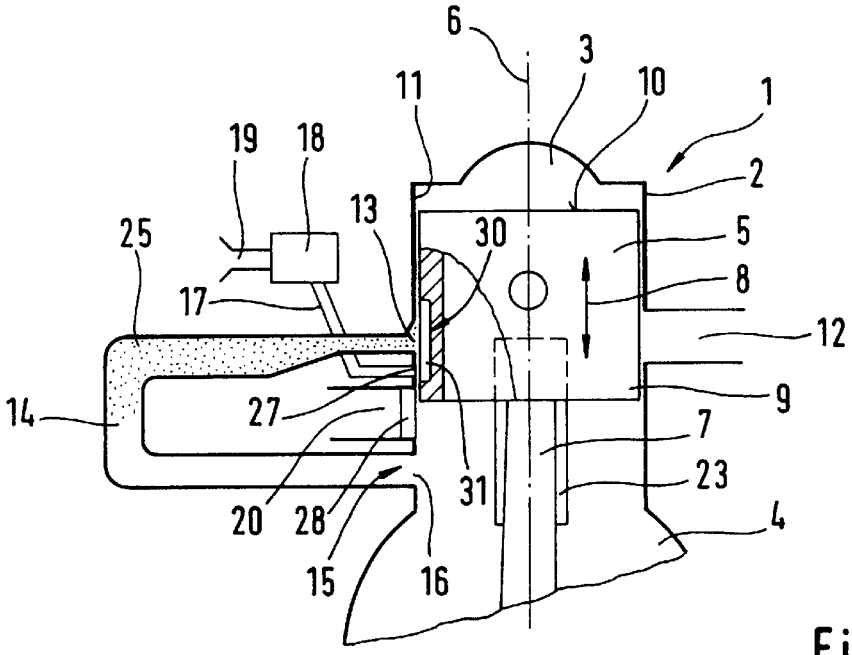
FIG. 1 is a partially cross-sectioned view of a portion of an internal combustion engine having exhaust gas enhanced mixture introduction.

The two-stroke engine of the present invention is characterized primarily in that the storage channel is connected with the mixture channel via a connecting channel that is controlled by the piston.

The core concept of the present invention is the connection and disconnection of the fuel supply, i.e. of the mixture channel, which is controlled by the piston and supplies the fuel to the storage channel. For this purpose, the piston is utilized as a structural control element for a connecting channel between the mixture channel and the inlet of the storage channel. In so doing, the connection between the mixture channel and the storage channel can be controlled in a structurally preset manner, so that the minimal time spans necessary in all operating conditions for the introduction of the required fuel can be fixed.

In this connection, it is expedient to connect the mixture channel with the storage channel via the inlet, whereby the connecting channel is formed in the piston, especially as a recess or groove in the skirt of the piston.

Pursuant to a further embodiment of the invention, the mixture channel and the inlet of the storage channel are disposed one above the other as viewed in the direction of the cylinder axis, whereby the mixture channel is disposed on that side of the inlet that faces the crankcase.

To ensure that initially the underpressure that exists in the crankcase is utilized for drawing the rich fuel/air mixture into the storage channel, it is provided that, as viewed in the direction of the cylinder axis, the crankcase inlet be disposed between the inlet of the storage channel into the combustion chamber and the controlled window of the storage channel to the crankcase. In so doing, as the piston moves upwardly first the window of the storage channel is opened, so that the underpressure can initially serve exclusively for drawing in the necessary rich fuel/air mixture. Due to the level of the crankcase inlet relative to the window of the storage channel, it can be periodically determined via which crankshaft angle the crankcase pressure acts exclusively upon the storage channel. After opening the crankcase inlet, the combustion air that is necessary for a subsequent combustion is drawn into the crankcase, whereby this combustion air can advantageously have mixed therewith small proportions of fuel in order to ensure the lubrication of the moving parts in the crankcase.

Further specific features of the present invention will be described in detail subsequently.

DESCRIPTION OF PREFERRED EMBODIMENTS

Referring now to the drawing in detail, the internal combustion engine illustrated in the drawing is a two-stroke engine 1 that is used in particular as a drive motor in a manually-guided implement such as a power chain saw, a brush cutter, a trimmer, a cut-off machine, a blower, or the like. As indicated, the internal combustion engine 1 is a two-stroke engine, which has a combustion chamber 3 formed in a cylinder 2; toward the crankcase 4, the combustion chamber 3 is delimited by a piston 5. The piston 5 reciprocates in the cylinder 2 in the direction of the longitudinal axis 6 of the cylinder, and via a connecting rod 7, drives a crankshaft that is mounted in the crankcase 4.

The piston 5, which reciprocates in the direction of stroke or travel 8, controls via its piston skirt 9, and with the edge of the head 10 of the piston, a plurality of windows that are provided in the inner wall 11 of the cylinder 2.

Associated with the combustion chamber 3, in the cylinder wall 11, is an outlet 12 by means of which exhaust gases that are formed in the combustion chamber 3 during the combustion of a fuel/air mixture are withdrawn.

Disposed approximately across from the outlet 12 in the cylinder wall is an inlet 13 via which fuel that is necessary for the operation is introduced into the combustion chamber 3 by means of a carrier air stream. The inlet 13 forms one end of a storage channel 14, which in the illustrated embodiment is embodied as an external channel of the internal combustion engine 1. The other end 15 of the storage channel 14 ends in a window 16 in the inner wall 11 of the cylinder 2, and leads to the crankcase 4. The inlet 13, as well as the window 16 of the storage channel 14, are openings that are controlled by the piston 5, i.e. are port-controlled openings.

The storage channel 14 is furthermore in communication with a fuel-supplying mixture channel 17 of a fuel supply 18, which can be embodied as a diaphragm carburetor. The diaphragm carburetor can draw in combustion air via an intake connection 19, whereby the drawn-in combustion air serves as a transport agent for the fuel that is to be introduced.

The combustion air needed for maintaining at least partial and full load operation is supplied to the combustion chamber 3 via the crankcase 4, for which purpose a crankcase inlet 20 for combustion air is provided. It can be expedient to also supply portions of fuel via the crankcase inlet 20, for which purpose the crankcase inlet can also be provided with a mixture-forming device 21 (see FIG. 2) such as a diaphragm carburetor. The combustion air drawn into the crankcase 4 is supplied to the combustion chamber 3 via a transfer channel 23 and a transfer window 24 that is controlled by the piston 5.

Figure 2:
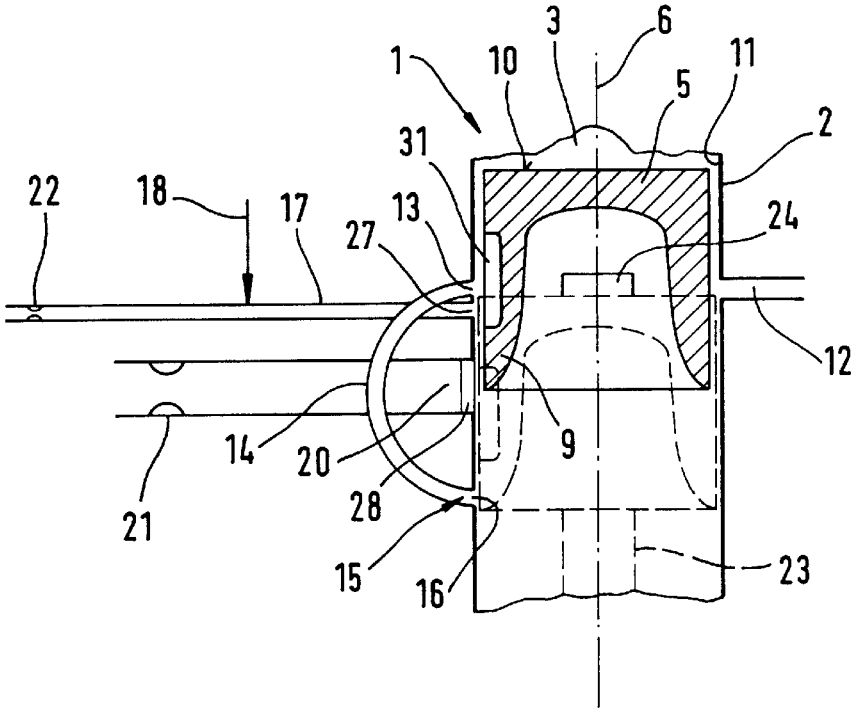
FIG. 2 is a view in accordance with FIG. 1 showing the piston in various stroke positions.

As illustrated in FIGS. 1 and 2, the mixture channel 17 is connected with the storage channel 14 via a connecting channel 30 that is controlled by the piston 5, whereby in the illustrated embodiment the mixture channel 17 is connectable via the connection channel 30 with the inlet 13 of the storage channel 14. For this purpose, the connecting channel 30 can expediently be embodied in the piston 5, for example as a recess 31 or as a groove in the piston skirt 9 of the piston 5. When viewed in the direction of the cylinder axis 6, the inlet 13, and the opening 27 of the mixture channel 17 in the inner wall 11 of the cylinder 2, are advantageously disposed one above the other, whereby the opening or mouth 27, in the direction of the cylinder axis 6, is disposed on that side of the inlet 13 that faces the crankcase 4.

The crankcase inlet 20 similarly opens out in the inner wall 11 of the cylinder 2, and in the direction of the cylinder axis 6 is disposed between the inlet 13 of the storage channel 14 into the combustion chamber 3, and the controlled window 16 of the storage channel 14 to the crankcase 4.

In the direction of travel 8 of the piston 5, in other words in the direction of the cylinder axis 6, the spacing of the inlet 13 from the window 16 to the crankcase 4 of the storage channel 14 is such that, with the inlet 13 opened to the combustion chamber 3, the piston 5 essentially closes off the window 16 to the crankcase 4. If the inlet 13 is closed by the piston 5, the window 16 at the other end 15 of the storage channel 14 to the crankcase 4 is opened.

Proceeding from a piston position as shown in FIG. 1, via the connecting channel 30 in the storage channel 14 a volume 25 of a fuel/air mixture is drawn in out of the mixture channel 17 via the connecting channel 30. The volume of the storage channel 14 is such that the fuel/air mixture 25 is essentially stored in the portion of the storage channel 14 that adjoins the inlet 13. Essentially no fuel enters the crankcase 4 via the window 16; it can be expedient to embody the configuration such that via the window 16 at the other end 15 of the storage channel 14, a small portion of the mixture enters the crankcase 4, where it contributes to the lubrication of the moving parts.

With the piston traveling in an upward direction, the crankcase inlet 20, via which the air is drawn into the crankcase 4, is also closed as is the window 16 of the storage channel 14. When the window 16 is closed by the piston skirt 9, to withdraw the combustion gases that are present in the combustion chamber 3 at high pressure, at approximately the same time the outlet 12 as well as the inlet 13 that extends toward the top of the combustion chamber are opened. As a result, the exhaust gas flows via the outlet 12, although a portion thereof enters under high pressure, through the inlet 13, into the storage channel 14 in order to flow as a pressure wave in the direction of the crankcase 4. Before the exhaust gas pressure wave in the storage channel 14 reaches the window 16, this window 16 is in the meantime completely closed by the piston skirt 9, so that the pressure wave is reflected at the piston skirt and flows back. Due to the upward movement of the piston 5, at this point in time the inlet 13 is essentially completely exposed, and at the same time the transfer window 24 of the transfer channel 23 is open, so that the combustion air that is compressed in the crankcase 4 flows into the combustion chamber 3 via the transfer window 24, and the returning exhaust gas wave pushes the rich mixture that is drawn in the storage channel 14 into the combustion chamber 3 via the inlet 13. In the combustion chamber 3, the rich mixture 25 mixes with the combustion air flowing in via the transfer window 24, and the mixture is compressed up to the time of ignition by the then upwardly moving piston 5. As the piston 5 moves upwardly, the opening 27 of the mixture channel 17 is connected with the inlet 13 via the connecting channel 30, so that the underpressure that is established in the crankcase 4 due to the upwardly moving piston 5 draws in fuel via the now open window 16 of the storage channel 14. Only as the piston continues to move upwardly is the crankcase inlet 20 for combustion air also opened; at this point in time, the rich fuel/air mixture 25 that is needed for a successive operating cycle is drawn into the storage channel 14. After ignition and reversal of the stroke movement of the piston 5, there is again effected a relief of the combustion chamber 3 via the outlet 12 accompanied by simultaneous entry of an exhaust gas wave into the storage channel 14 via the inlet 13. The operating cycle begins again.

In FIG. 2, the lower dead center position of the piston is indicated by dashed lines, and the upper dead center position of the piston 5 is shown by solid lines. For the supply of the fuel, a mechanical fuel supply 18 can be provided, such as a needle valve or the like. A supply of the fuel that is controlled by underpressure is expediently provided, for which purpose a venturi section 22 is formed in the mixture channel 17.

The illustrated connection of the mixture channel 17 with the storage channel 14 via a connecting channel 30 in the piston provides a structural possibility for the presetting of the control times. It must be ensured in each stroke position of the piston 5 that the connecting channel 30 does not establish a flow connection between the crankcase inlet 20 and the opening 27 of the mixture channel 17, or the inlet 13 of the storage channel 14. This can be achieved by a lateral offset of the crankcase inlet 20 relative to the inlet 13 or the mouth 27, or by a crossbar 28 in the window of the crankcase inlet 20 that closes off the groove 31 in the piston 5.

The specification incorporates by reference the disclosure of German priority document 101 28 197.8 of Jun. 11, 2001.

The present invention is, of course, in no way restricted to the specific disclosure of the specification and drawing, but also encompasses any modifications the scope of the appended claims.

We claim:

1. A two-stroke engine comprising:

a cylinder in which is formed a combustion chamber, wherein said cylinder is provided with an inlet for supplying fresh fuel/air mixture to said combustion chamber, and an outlet for a withdrawal of exhaust gas from said combustion chamber;

a piston that is reciprocatingly disposed in said cylinder and delimits said combustion chamber;

a crankcase, wherein said piston, via a connecting rod, is adapted to drive a crankshaft that is rotatably mounted in said crankcase, wherein said crankcase is provided with a crankcase inlet for combustion air, and a transfer channel, wherein a first end of said transfer channel communicates with said crankcase, and wherein a second end of said transfer channel opens into said combustion chamber via a transfer window;

a storage channel, a first end of which is formed by said inlet of said cylinder, and a second end of which opens into said crankcase via a window that is controlled by said piston;

a mixture channel of a fuel supply for supplying fuel; and a connecting channel that is controlled by said piston, wherein said storage channel is connected to said mixture channel via said connecting channel.

2. A two-stroke engine according to claim 1, wherein said mixture channel is connectable with said storage channel via said inlet of said cylinder.

3. A two-stroke engine according to claim 1, wherein said connecting channel is formed in said piston.

4. A two-stroke engine according to claim 3, wherein said connecting channel is embodied as a recess in a piston skirt of said piston.

5. A two-stroke engine according to claim 1, wherein said mixture channel and said inlet of said storage channel are disposed one above the other relative to an axis of said cylinder.

6. A two-stroke engine according to claim 5, wherein relative to said cylinder axis, said mixture channel is disposed on a side of said inlet of said cylinder that faces said crankcase.

7. A two-stroke engine according to claim 1, wherein said crankcase inlet, relative to an axis of said cylinder, is disposed between said inlet of said storage channel that leads to said combustion chamber, and said window of said storage channel that leads to said crankcase.

8. A two-stroke engine according to claim 1, wherein said inlet of said cylinder is open to said combustion chamber, said piston essentially closes off said window of said storage channel that leads to said crankcase, and vice versa.

9. A two-stroke engine according to claim 1, wherein in any stroke position of said piston, neither said inlet of said cylinder nor a mouth of said mixture channel is in flow communication with said crankcase inlet.

10. A two-stroke engine comprising:

a cylinder in which is formed a combustion chamber, wherein said cylinder is provided with an inlet for supplying fresh fuel/air mixture to said combustion chamber, and an outlet for a withdrawal of exhaust gas from said combustion chamber;

a piston that is reciprocatingly disposed in said cylinder and delimits said combustion chamber;

a crankcase, wherein said piston, via a connecting rod, is adapted to drive a crankshaft that is rotatably mounted in said crankcase, wherein said crankcase is provided with a crankcase inlet for combustion air, and a transfer channel, wherein a first end of said transfer channel communicates with said crankcase, and wherein a second end of said transfer channel opens into said combustion chamber via a transfer window;

a storage channel, a first end of which is formed by said inlet of said cylinder, and a second end of which opens into said crankcase via a window that is controlled by said piston;

a mixture channel of a fuel supply for supplying fuel; and a connecting channel that is controlled by said piston, wherein said storage channel is respectively connected to and disconnected from said mixture channel via said piston-controlled connecting channel for supplying fuel, or interrupting a supply of fuel, to said storage channel.

* * * * *